US005117764A

United States Patent [19]

Kretzer, Jr.

[11] Patent Number: 5,117,764

[45] Date of Patent: Jun. 2, 1992

[54] PROTECTIVE HULL LINER FOR JET SKIS

[76] Inventor: Richard E. Kretzer, Jr., 134 Hartle Dr., Hagerstown, Md. 21740

[21] Appl. No.: 683,464

[22] Filed: Mar. 28, 1991

[51] Int. Cl.[5] ..... B63B 17/00

[52] U.S. Cl. ..... 114/361

[58] Field of Search ..... 114/355, 357, 359, 360, 114/361, 343, 74 A, 219, 222, 229, 270; 150/166

[56] References Cited

U.S. PATENT DOCUMENTS

| | | | |
|---|---|---|---|
| 3,220,026 | 11/1965 | Lichti | 114/219 |
| 4,667,619 | 5/1987 | Nishida | 114/361 |
| 4,697,762 | 10/1987 | Arney | 244/101 |
| 4,739,723 | 4/1988 | Plucknett | 114/361 |
| 4,892,055 | 1/1990 | Schad | 114/219 |
| 4,909,172 | 3/1990 | Hamby | 114/219 |

FOREIGN PATENT DOCUMENTS

| | | | |
|---|---|---|---|
| 1140846 | 1/1969 | United Kingdom | 114/355 |

*Primary Examiner*—Jesus D. Sotelo
*Attorney, Agent, or Firm*—Dowell & Dowell

[57] ABSTRACT

A protective liner for jet skis which includes a bow, bottom, and side wall portions which are secured in relatively spaced and covering relationship to the existing hull in such a manner as to allow fluid to pass therebetween.

6 Claims, 2 Drawing Sheets

FIG. 1
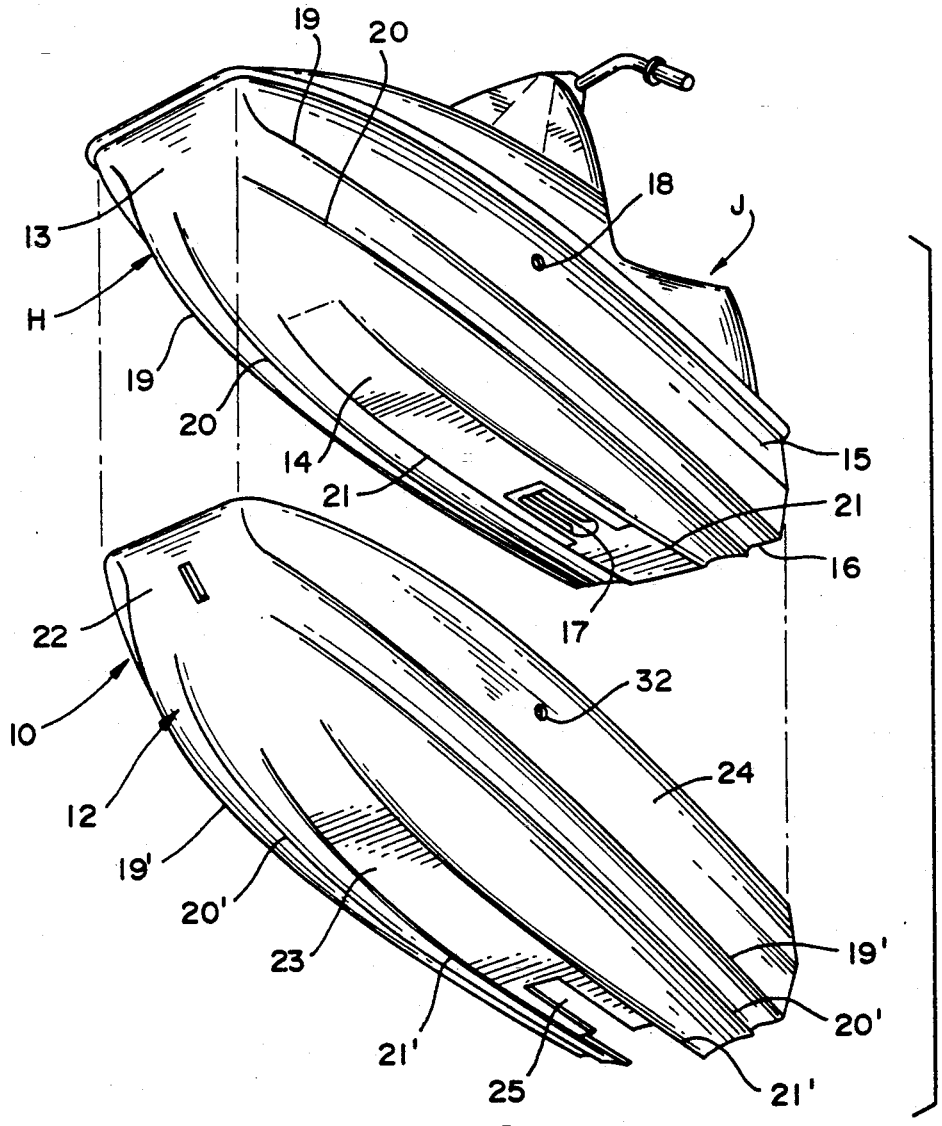
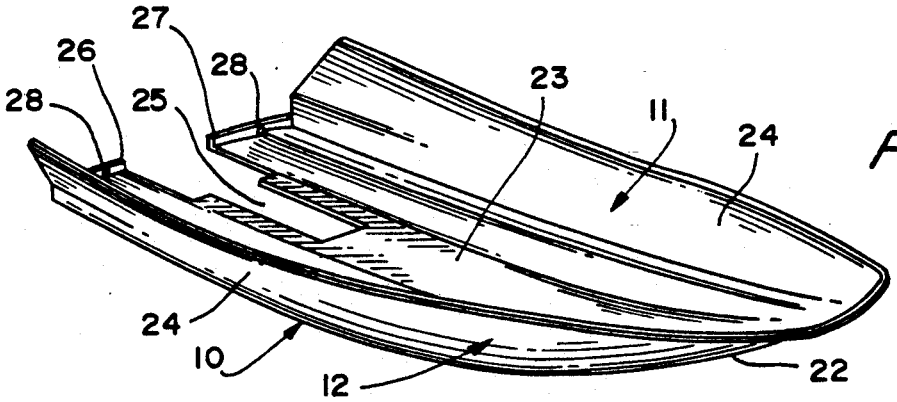
FIG. 2

PROTECTIVE HULL LINER FOR JET SKIS

BACKGROUND OF THE INVENTION

1. Field of the Invention

This invention is generally directed to powered small personal watercraft such as water sleds or jet skis and more particularly to a protective liner which may be secured in spaced relationship with respect to an existing hull so as to form a protective liner for the hull of a type that substantially covers the bow, bottom and side portions of the hull in such a manner as to not adversely affect the planing characteristics of the hull when the watercraft is in use. The protective liner is a molded one piece plastic shell which in the preferred embodiment may further include stern wall portions which are selectively engagable with the stern wall of the watercraft and through which openings are provided to permit drainage of fluid from the space between the protective liner and the hull of the watercraft.

2. History of the Related Art

The popularity and use of individualized watercraft such as jet sleds or jet skis is ever increasing especially as such craft are generally low cost and easily transportable from one location to another. Further, such watercraft do not require specialized launching facilities and therefore such craft may be utilized in areas where other types of watercraft cannot be suitably launched. Further, with the advent of jet propulsion system which do not utilize an types of mechanical props it is possible to launch or dock such vehicles directly onto the bank or the shore along a given body of water as there is no mechanical obstruction which can be damaged by the watercraft planing onto a solid surface. However, due to the natural tendency to launch such vehicles directly from the shoreline, damage frequently occurs to the hull of the boat by the hull striking rocks, branches or other debris along the shoreline.

In view of the foregoing, many jet ski enthusiasts find that they must frequently have the hulls of such watercraft patched or repaired. During maintenance processes it is important to ensure that the repair to the hull is accomplished in such a manner that the outline of the hull or its true outer skin configuration is not adversely affected. If repairs are made which result in protrusion or uneven surface characteristics along the outer surface of the hull then the planing action of the hull will be adversely affected thereby modifying the maneuverability of the jet ski when in use. Further, in many instances where repair is necessary, after a plug or patch has been made the hull must thereafter be repainted in order to maintain not only the aesthetic characteristics of the hull shape and design but also to seal any plugs or patches. In view of the foregoing, the cost of repairs may be significant and the time for accomplishing the repairs may mean the unavailability of the watercraft for an extended period of time.

In the past there have been a number of innovations proposed for protecting the hulls of different types of watercraft. Due to the size of hulls of even small watercraft, including conventional motor boats and the like, concern has been primarily directed to protecting only small portions of the boat hull. In U.S. Pat. No. 3,220,026 to Lichti, a hull protector is disclosed which includes a clear plastic shield which is directly adhesively secured to the bow portion of the hull in the area of the keel. With this structure the forward portion or bow portion of the hull is provided with an additional covering layer for protecting the bow portion against impacting objects both in the water and objects encountered when the boat is being landed or loaded upon a trailering vehicle. Such structure, however, does not provide adequate protection for the remaining portion of the hull, and further, due to the size of the hull such protection would probably be impractical and economically prohibitive. Further, due to the numerous shapes of hulls of existing small boats, providing separately moldable protective coverings for each bow component would not be practical.

Another protective device for the keel portion of the bow of a boat hull is disclosed in U.S. Pat. No. 4,909,172 to Hamby. This patent discloses the use of an elongated strip of flexible resilient solid material which is adhered by adhesive strips to the keel portion of the bow. The resilient material is provided only along a portion of the length of the keel at the bow of the hull and extends for a short distance on either side of the keel. The material is provided only to protect the keel from impacting objects and does not otherwise provide a cover for or protect other portions of the hull.

U.S. Pat. No. 4,892,055 to Schad discloses a reinforcement for watercraft wherein the bottom portion of the hull is provided with both a primary and a secondary skin or layer. The secondary skin is provided as a removable protective layer which is keyed into specially designed T-shaped slots formed in the primary skin. In this manner, the secondary skin may be removed in the event of wear or damage and replaced. Unfortunately, with such a structure the bottom of the hull must be specifically shaped so as to provide a mechanical interlock for the secondary skin. Such a structure would not be possible for most watercraft as the configuration of the bottom of the hull would not be conducive to allow mechanical interlocking. Further, such mechanical interlocking can adversely affect the planing characteristics of the hull in the water.

Another type of mechanically interlocked protective layer for small watercraft, including water skis, is disclosed in U.S. Pat. No. 4,667,619 to Nishida. In this patent a flexible bottom wall protector is disclosed which is designed to be interfitted within specially designed slots formed in the bottom of the hull of the watercraft. The hull protector extends from the bow to the stern of the boat but only along a centralized portion of the bottom. Further, the protective liner must be interfitted within a tongue and groove arrangement and is seated against the primary hull without any space being created therebetween. With this type of structure the hull of the boat must be specifically designed to accept the outer protective layer s that the outer protective layer actually forms or creates the planing surface of the hull. Therefore, if the protective layer is removed the total planing characteristics of the hull are changed to a degree which would not be suitable for normal use. Thus, it is likely that the protective layer must always be present on the hull when the vehicle is in use and therefore the purchaser must acquire the protective liner when the water vehicle is initially purchased.

Additional patents of interest include U.S. Pat. Nos. 4,697,762 to Arney and 4,739,723 to Plucknett.

SUMMARY OF THE INVENTION

This invention is directed to a protective liner for use with small watercraft, and particularly jet skis, wherein the hull of the jet ski includes a bow, bottom, opposite side walls and stern wall, each of which includes an outer surface having a particular configuration or shape and wherein the protective liner includes a shell having a generally concave inner surface and convex outer surface with the outer surface having a configuration which is the same as that of the existing hull so that when the shell is adhesively secured in spaced relationship with respect to the hull, the planing characteristics of the vehicle will be identical to that of the vehicle without the protective liner being applied thereto. With the invention, the shell forming the protective liner includes a bow wall, bottom wall and opposite side walls which are adhesively secured by strips of adhesive tape which are utilized to space the shell in close proximity to the existing hull so that fluid may pass between the shell and the hull. In the preferred embodiment, the stern portion of the bottom wall is bifurcated so as to permit the liner to be applied on either side of the opening provided in the hull of the jet ski for the propulsion system and the shell further includes upwardly extending flanges which are adhesively secured to the stern of the hull of the watercraft. To further facilitate the passage of fluid between the hull and the protective liner openings may be provided in the rear flanges of the shell.

In addition to the foregoing, the adhesive tape is preferably a double sided acrylic foam tape which is impregnated with adhesive and which is utilized to space the protective liner at a distance not to exceed approximately 1.0–1.5 mm from the hull with the strips of tape being applied between the shell and the hull in such a manner that fluid flow there between is not obstructed.

It is a primary object of the present invention to provide a protective liner for small watercraft and especially jet skis wherein the liner may be applied to a jet ski to cover substantially the entire bow, bottom and side wall portions of the hull thereby giving the hull an entirely new appearance while simultaneously providing a protective cover for portions of the hull which may have been previously damaged or to protect against future damage.

It is another object of the present invention to provide a protective liner for jet skis and the like wherein damage to a hull may be easily prepared with the damaged portion of the hull being covered simultaneously with the remaining portion of the hull with a protective shell which substantially completely covers the bow, side wall and bottom portion of the existing hull in such a manner that the planing characteristics of the hull remain the same as they were with the original hull configuration.

It is also a object of the present invention to provide a protective liner for use in covering the hulls of jet skis and the like wherein the protective liner is specifically designed to be secured to the existing hull by adhesive strips which create a positive air space between the liner and the hull so that fluid, including water, may easily pass there between whereby buildup of any moisture between the hull and the liner is effectively prevented when the vehicle is not in use but which permits water to enter the air space during vehicle use so that the water acts as a damper to absorb shocks to the hull and liner.

It is yet another object of the present invention to provide a one piece molded protective liner for covering a substantial portion of the hull of a watercraft such as a jet ski wherein the liner may be applied to existing jet skis without modification to the hull of such a watercraft.

BRIEF DESCRIPTION OF THE DRAWINGS

FIG. 1 is a perspective assembly view of the protective liner of the present invention shown relative to the hull of a jet ski.

FIG. 2 is a front perspective view of the protective liner of the present invention.

DESCRIPTION OF THE PREFERRED EMBODIMENT

Figure 3:
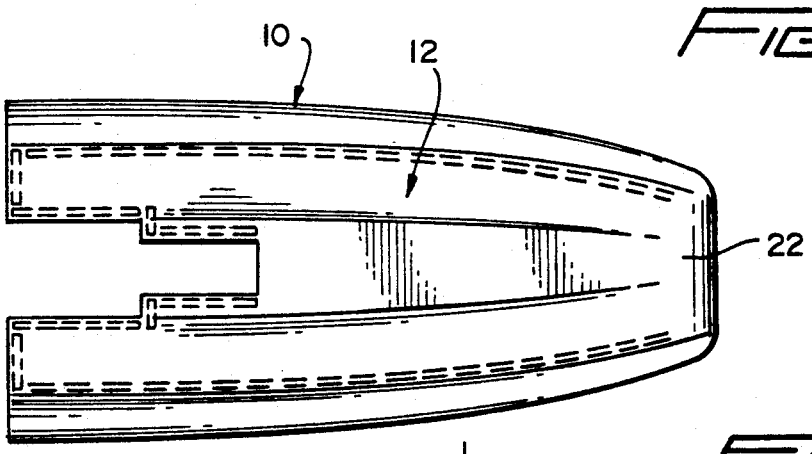
FIG. 3 is a bottom plan view of the protective liner of the present invention showing adhesive strips for securing the liner to the hull of a jet ski in dotted line.

With continued reference to the drawings, the protective liner of the present invention includes a shell 10 having an interior concave surface 11 and exterior generally convex surface 12. The shell is designed to be cooperatively secured in covering or overlaying relationship with respect to the existing hull H of a small watercraft such as a jet ski J.

The hull of the watercraft includes a bow portion 13, bottom wall 14, a pair of side walls 15 and a stern wall 16. The jet ski is normally powered by a propulsion unit which is open to the water through an opening 17 through the bottom 14 adjacent the stern 16 of the hull. In some instances the hull of the jet ski may also include auxiliary bilge openings 18 through which water may be discharged from the vehicle.

It should be noted that the shell 10 of the present invention will vary in overall configuration depending upon the exact shape of the hull to which the shell is to be applied. As noted in the drawing figures, the hulls associated with conventional watercraft such as jet skis will have different configurations depending upon the manufacturer. However, each hull will probably include a plurality of stem to stern oriented ridges such as shown at 19–21, which are generally equally spaced on either side of the center line of the bow and which are provided for developing a particular planing action of the hull through the water.

As previously discussed, the protective liner of the present invention is designed to substantially cover the entire bow, bottom and side wall portions (13, 14 and 15 of the jet ski J). To this end the shell includes a bow wall 22, bottom wall 23 and opposite side walls 24. In order to exactly conform the shape of the shell to the shape of the hull H compatible ridges 19', 20' and 21' are provided on opposite sides of the center line of the shell, as shown in FIG. 1. The stern portion of the bottom wall 23 is also shown as being bifurcated so as to create a key shaped opening 25 through which the jet propulsion opening 17 is exposed. In the preferred embodiment, the shell also includes a pair of upstanding flanges 26 and 27 which are designed to be secured to the stern wall 16 of the hull. To facilitate the passage of fluid, both air and water, from between the shell 10 and the hull H at least one opening 28 is provided through each of the flange portions 26 and 27.

Figure 4:
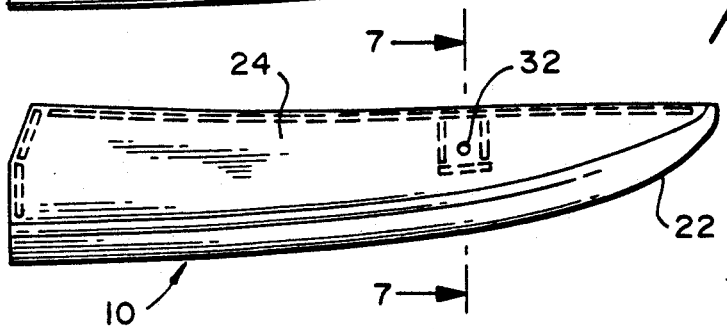
FIG. 4 is a right side elevational view of the protective liner of the present invention.
Figure 5:
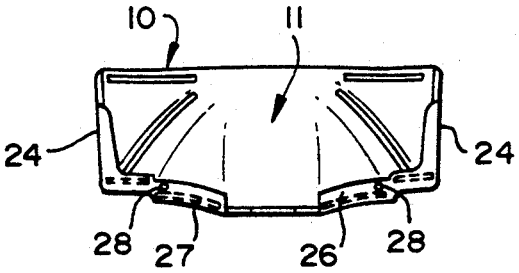
FIG. 5 is a rear elevational view of the protective liner of the present invention.
Figure 6:
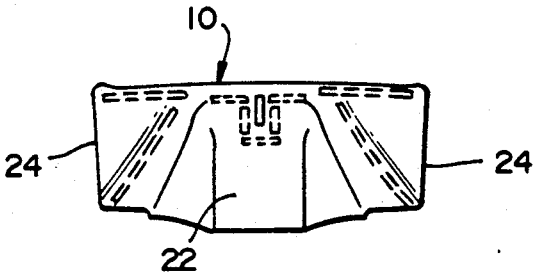
FIG. 6 is a front elevational view of the protective liner of the present invention.
Figure 7:
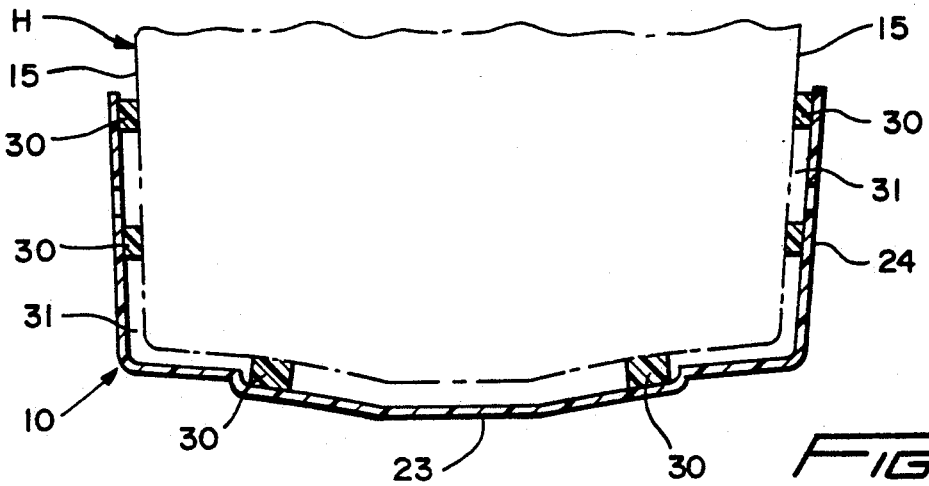
FIG. 7 is an enlarged cross-sectional view taken along line 7—7 of FIG. 4 with a jet ski shown in dotted line.

With particular reference to FIGS. 3–7, the shell 10 is secured to the existing hull by the use of adhesive tape which is preferably a double sided adhesive tape manufactured of an acrylic foam impregnated with an adhesive material. Such a tape is manufactured under the trademark of SCOTCH BRAND VHB sold by 3M Corporation. The tape provides a physical spacer so that the shell 10 when adhered to the hull H is spaced in relationship thereto so that fluid may pass between the shell and the hull as is clearly shown in FIG. 7. The strips of adhesive tape are designated at 30 and they are applied between the hull so as to be in spaced relationship with respect to one another so that the tape does not interfere with the flow of fluid between the hull and the shell. The tape provides air spaces 31 between the shell and the hull with such air spaces having a dimension generally equal to between 1.0–1.5 mm and preferably 1.1 mm. The adhesive tape is provided along the bow and stern portions of the shell and along the uppermost edges of the sides 24, along the intermediate height of the sides 24 and along at least two spaced lines along the bottom wall 23 of the shell. Additional tape is provided adjacent the key opening 25 and around a supplemental opening 32 provided through the shell which opening will overlie the bilge opening 18 into the hull H of the jet ski J.

After the protective liner has been applied and when the jet ski is in use, water is permitted to enter into the air spaces 31 and thereby acts as a damper to absorb shocks to the liner and hull. When the jet ski is not in use, the water between the liner and hull will freely drain and thereby prevent moisture buildup within the air spaces.

As previously discussed, it is preferred that the shell be molded in a single piece so that it may be easily applied in a very short time to the existing hull of a jet ski. The shell is preferably molded approximately $\frac{1}{8}$ thick of an ABS plastic material, although other types of plastic may be utilized. It is important to ensure that the type of material from which the shell is made is durable due to the wear and tear which normally occurs through the use of the jet ski.

The protective liner of the present invention is specifically designed to be utilized to cover the existing hull H of a jet ski J after there has been significant wear and perhaps structural damage to the existing hull. In some cases, individuals may desire to renew the aesthetic appearance of the hull of the jet ski and in others, repair work may be necessary to the hull. In either case, once the hull has been repaired by patching any cracks or holes or other structural damage the two sided adhesive tape is applied either to the interior surface of the shell 10 or to the exterior surface of the hull. The tape is applied so that an air space is created along the entire length of the hull so that any water may freely pass between the protective liner and the hull to thereby avoid accumulation or buildup of moisture in the space therebetween when the jet ski is not in use.

After the tape has been applied to one or the other of the hull or the protective shell, the outer protective covering of the tape is removed and thereafter the shell mounted to the hull in such a manner that the shell assumes the outer configuration or shape of the existing hull so that the planing characteristics of the watercraft are not altered.

I claim:

1. A protective shell for the hull of jet skis where the hull includes a bow, bottom, opposite side walls and stern wall, a propulsion opening in said bottom wall of the hull, and wherein the hull has a particularly shaped outer surface and wherein the protective shell comprises a generally concave inner surface and convex outer surface, said shell having a bow wall, a bottom wall and side walls each of which is of a configuration to be compatible to the shaped outer surface of the hull so that said shell cooperatively covers substantially the entire bow, bottom and opposite side walls of the hull, said bottom wall of said shell including a stern end portion, said stern end portion being bifurcated so as to extend along opposite sides of said propulsion opening, a plurality of adhesive strip means disposed between said inner surface of said shell and the outer surface of the hull for securing said shell in spaced relationship with respect to the hull, and said adhesive strip means being spaced from one another so as to permit water to pass therebetween and between said shell and the hull.

2. The protective shell for jet skis of claim 1 in which said shell includes a pair of spaced upstanding stern flange portions, said stern flange portions being secured in spaced relationship tot he stern wall of the hull.

3. The protective shell for jet skis of claim 2 including at least one opening through each of said stern flange portions for permitting a flow of fluid therethrough.

4. A method for repairing the hull of a jet ski wherein the hull includes a bow, bottom and opposite side walls and wherein the bow has been damaged at a given area causing an opening therein comprising the steps of sealing the opening in the bow and thereafter adhesively securing a one piece molded plastic protective shell to said hull so a to be in spaced relationship with respect thereto and wherein said hull is substantially covered in the areas of said bow, bottom and side walls thereof.

5. A protective shell for the hull of jet skis where the hull includes a bow, bottom, opposite side walls and stern wall and wherein the hull has a particularly shaped outer surface and wherein the protective shell comprises, a generally concave inner surface and convex outer surface, said shell having a bow wall, a bottom wall and side walls each of which is of a configuration to be compatible to the shaped outer surface of the hull so that said shell cooperatively covers substantially the entire bow, bottom and opposite side walls of the hull, said shell including upstanding stern flange portions, said stern flange portions being secured in spaced relationship to the stern wall of the hull, a plurality of adhesive strip means disposed between said inner surface of said shell and the outer surface of the hull for securing said shell in spaced relationship with respect to the hull, and said adhesive strip means being spaced from one another so as to permit water to pass therebetween and between said shell and the hull.

6. The protective shell for jet skis of claim 5 including at least one opening through said stern flange portions for permitting a flow of fluid therethrough.

* * * * *